United States Patent [19]

Shimogawara

[11] Patent Number: 4,828,245

[45] Date of Patent: May 9, 1989

[54] SHEET FEEDER SUITABLE FOR FEEDING THICK SHEETS

[75] Inventor: Jun Shimogawara, Tokyo, Japan

[73] Assignee: NEC Corporation, Tokyo, Japan

[21] Appl. No.: 69,748

[22] Filed: Jul. 6, 1987

[30] Foreign Application Priority Data

Jul. 3, 1986 [JP] Japan ..... 61-157247

[51] Int. Cl.[4] ..... B65H 1/00

[52] U.S. Cl. ..... 271/171; 271/170; 271/160

[58] Field of Search ..... 271/114, 147, 160, 167, 271/169–171

[56] References Cited

U.S. PATENT DOCUMENTS 390,277 10/1988 Allen .
3,601,389 8/1971 Krammer .
4,623,138 11/1986 Sukamaki et al. ..... 271/169
4,635,919 1/1987 Habich et al. ..... 271/170

FOREIGN PATENT DOCUMENTS 58-31830 2/1983 Japan .
47739 3/1983 Japan ..... 271/170
202228 11/1983 Japan ..... 271/160
198231 11/1984 Japan ..... 271/160

*Primary Examiner*—H. Grant Skaggs
*Attorney, Agent, or Firm*—Sughrue, Mion, Zinn, Macpeak & Seas

[57] ABSTRACT

A sheet feeder for feeding thin sheets is adapted to the feeding of thick sheets by a thick sheet feeding attachment having a pair of slits separated by a distance smaller than the distance between pawls used for separating thin sheets, thereby disabling the separating function of the pawls.

6 Claims, 5 Drawing Sheets

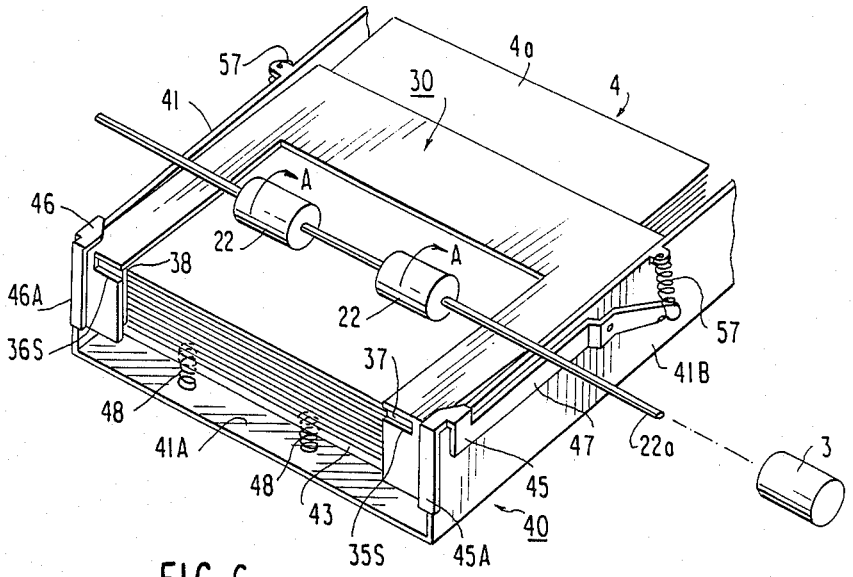
FIG.6
FIG.7
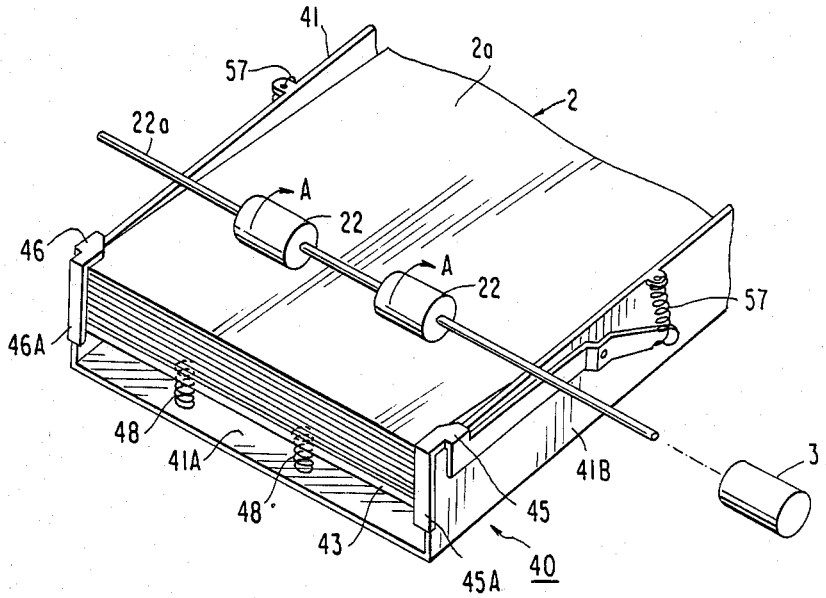

SHEET FEEDER SUITABLE FOR FEEDING THICK SHEETS

BACKGROUND OF THE INVENTION

The present invention relates to a sheet feeder for separating a sheet from stacked sheets in a sheet storage cassette and for feeding the sheets one by one to a printing mechanism of a printer, a copying machine, a typewriter or the like.

A conventional sheet feeder as disclosed in U.S. Pat. No. 4,438,915 includes a sheet storage cassette (sheet hopper) which stores the stacked cut sheets and feed rollers which feed out one of the cut sheets out of the sheet storage cassette. The sheet storage cassette is provided with a hopper plate on its inside bottom. The hopper plate is urged by a spring so as to press the stacked sheets toward the feed rollers. The uppermost sheet of the stacked sheets is therefore constantly pressed on the feed rollers. A pair of separator pawls are provided on both corners of a sheet exit side of the sheet storage cassette. When the feed rollers are rotated, the uppermost sheet is bent and deflected between the pawls and the feed rollers. Owing to the deflection of the uppermost sheet, a restoration force of the uppermost sheet occurs and the sheet rides beyond the separator pawls. Thus, the uppermost sheet is separated from the stacked sheets and is fed out of the sheet storage cassette.

The conventional sheet feeder separates the uppermost sheet from the stacked sheets by utilizing flexibility and restorativeness of the sheet, as described above. Accordingly, the conventional sheet feeder cannot deal with thick sheets, e.g., post cards, envelopes and the like which lack of the flexibility and the restorativeness. In other words, the conventional sheet feeder cannot feed the thick sheets one by one to the printing mechanism.

SUMMARY OF THE INVENTION

Accordingly, an object of the present invention is to provide a sheet feeder which can separate a thick sheet from stacked thick sheets stored in a sheet storage cassette and feed it out without deflecting the thick card.

The sheet feeder according to the present invention comprises a hopper housing for storing stacked thick sheets, feed rollers for feeding the thick sheets out of the hopper housing by contacting the uppermost sheet of the stacked thick sheets, and separators provided on the hopper housing, each of the separators being provided with a slit to permit the passage of only the uppermost sheet therethrough. Friction members made of an elastic material may be attached to cover a part of the slits of the separators.

BRIEF DESCRIPTION OF THE DRAWINGS

The other features and advantages of the present invention will be better understood from the following description of preferred embodiments of this invention taken in conjunction with the accompanying drawings wherein:

FIG. 6 is a perspective view showing the sheet feeder of the second embodiment when an attachment is attached;

FIG. 7 is a perspective view showing the sheet feeder of the second embodiment when the attachment is detached;

DESCRIPTION OF THE PREFERRED EMBODIMENTS

Figure 1:
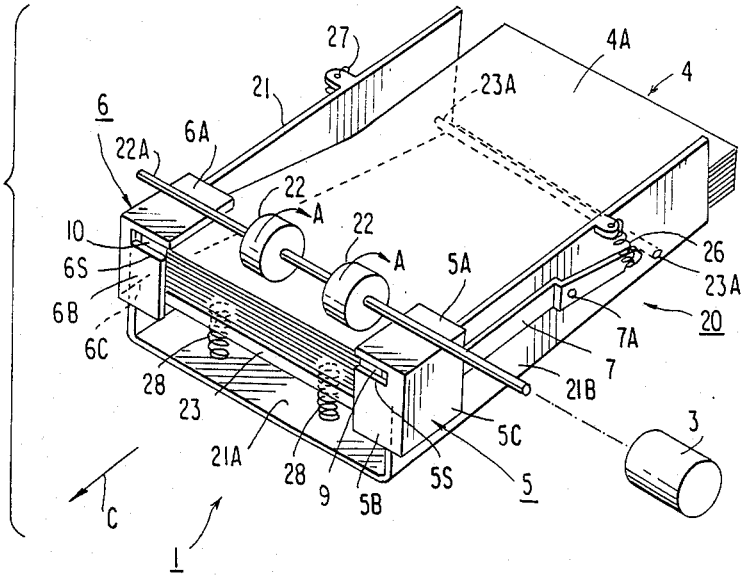
FIG. 1 is a perspective view showing a sheet feeder according to a first embodiment of the present invention.
Figure 2:
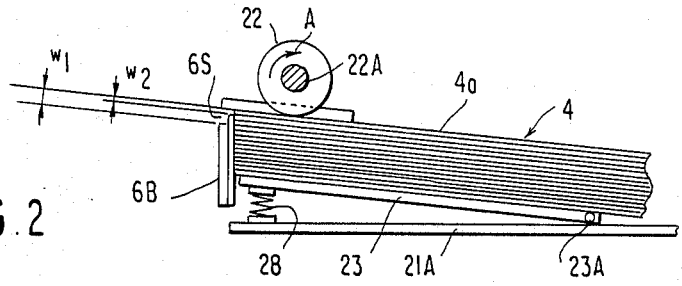
FIGS. 2 and 3 are sectional views showing an operation of the sheet feeder shown in FIG. 1.
Figure 3:
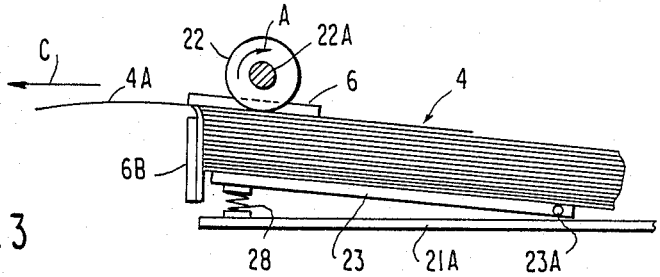

FIGS. 1 to 3 show a sheet feeder 1 according to a first embodiment of the present invention. The sheet feeder 1 includes a sheet storage cassette 20 and feed rollers 22 provided on a sheet exit portion of the sheet storage cassette 20. A rotary shaft 22A of the feed rollers 22 is connected to a drive motor 3 as well known in the art, for instance, as disclosed in aforementioned U.S. Pat. No. 4,438,915. The feed rollers 22 are rotated by the drive motor 3 in the direction indicated by arrow A. The sheet storage cassette 20 includes a hopper housing 21 for storing stacked thick sheets 4 of post cards, envelopes and so on. A hopper plate 23 is provided on the inside bottom 21*a* of the hopper housing 21 by a rotary shaft 23A. The hopper plate 23 is provided with springs 28 which are secured to the inside bottom 21A. The hopper plate 23 is urged by the springs 28 upwardly so as to keep the stacked sheets 4 pressed toward the feed rollers 22. Therefore, the uppermost sheet 4A of the stacked sheets 4 is constantly pressed against the feed rollers 22.

Separators 5 and 6 are attached on both corners of the hopper housing 21 at the sheet exit portion. The separators 5 and 6 include upper walls 5A and 6A facing the upper surface of the stacked sheets 4, front walls 5B and 6B and side walls 5C and 6C formed perpendicularly to the upper walls 5A and 5B, respectively. Swinging arms 7 are integrally attached to the side walls 5C and 6C of the separators 5 and 6 at one ends. The swinging arms 7 are rotatably provided on side walls 21B of the hopper housing 21 by rotary shafts 7A, respectively. The other ends of the swinging arms 7 are provided with tension springs 66 and 27 which are secured to the side walls 21B. Thus, the separators 5 and 6 are urged downward so that the upper walls 5A and 5B press the stacked sheets 4 downward.

The front walls 5B and 6B of the separators 5 and 6 are formed with slits 5S and 6S at their boundary portions to the upper walls 5A and 6A, respectively. Friction members 9 and 10 in the form of a plate and made of an elastic material such as stainless steel spring are attached inside of the front walls 5B and 6B. A part of the slits 5S and 6S are covered by ends of the friction members 9 and 10 as shown in FIGS. 2 and 3. The width $w_1$ of the slits 5S and 6S and the clearance $w_2$ between the friction members 9 and 10 and the upper walls 5A and 6A are determined by the thickness of the thick sheets 4. For instance, when the thickness of the sheets 4 is 0.22 mm, the width $w_1$ and the clearance $w_2$ are favorably 2.00 mm and 0.16 mm, respectively.

When the feed rollers 22 are rotated, the uppermost sheet 4A of the stacked sheet 4 is forced to advance in the direction indicated by arrow C against the retaining force of the friction members 9 and 10 as shown in FIGS. 2 and 3 to be fed to a printer or the like. Although other lower sheets of the stacked sheets 4 are also pulled forward by the rollers 22, the lower sheets are not fed due to the friction between the sheets themselves and between the sheets and the friction members 9 and 10. Thus, only the uppermost sheet 4A can be fed out of the sheet storage cassette 20

Next, a sheet feeder according to a second embodiment of the present invention will now be described referring to FIGS. 4 through 7.

The second embodiment is characterized in that the thick sheet feeding function is realized by attaching a thick sheet feeding attachment 30 to a conventional sheet storage cassette while the first embodiment is dedicated for the sheet feeder for feeding only the thick sheets.

Figure 4:
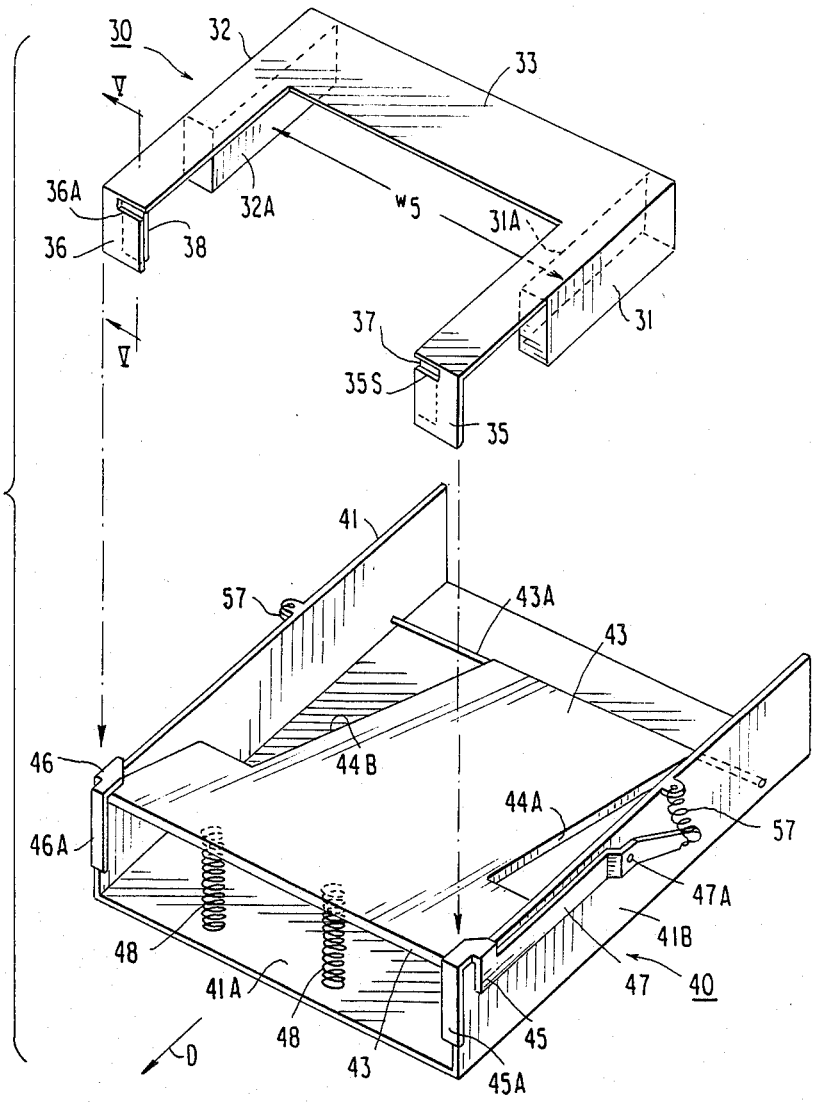
FIG. 4 is a perspective view showing a sheet feeder according to a second embodiment of the present invention.

Referring to FIG. 4, a thick sheet feeding attachment 30 is attached on a sheet storage cassette 40 which is designed to feed thin sheets. The sheet storage cassette 40 includes a hopper housing 41 which stores the thick sheets 4 or thin sheets 2. A hopper plate 43 is provided on the inside bottom 41A of the hopper housing 41 by a rotary shaft 43A. The hopper plate 43 is lifted from the inside bottom 41A by springs 48. The hopper housing 41 is provided with pawls 45 and 46 at both corners thereof on a sheet exit portion. The pawls 45 and 46 are integrally formed with one ends of levers 47 which are rotatably provided on side walls 41B of the hopper housing 41 by rotary shafts 47A. The other ends of the levers 47 are provided with springs 56 and 57 so that the pawls 45 and 46 are urged downward to the corner of the hopper housing 41. The pawls 45 and 46 have front walls 45A and 46A to prevent the thin sheets stacked in the housing 41 from advancing in the direction indicated by arrow D. It should be noted that the hopper plate 43 is notched at both sides to form notches 44A and 44B to receive legs 31 and 32 of the attachment 30.

The thick sheet feeding attachment 30 has a C-shaped upper wall 33 whose lower surface is provided with the legs 31 and 32 at both sides and front walls 35 and 36 extending downward from the front edge. The front walls 35 and 36 are formed with slits 35S and 36S at boundary portions to the upper walls 33. Friction members 37 and 38 are formed on inside of the front walls 35 and 36 to cover a part of the slits 35S and 36S in a similar manner to the first embodiment.

Figure 5:
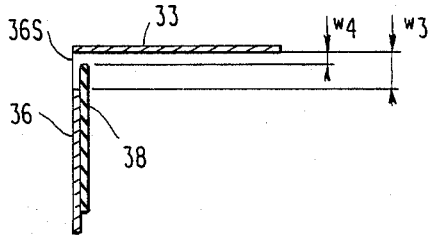
FIG. 5 is a cross sectional view taken along the line V—V of FIG. 4.

Referring also to FIG. 5, the friction member 38 is made of elastic material such as stainless steel spring. The width of the slit $w_3$ and the clearance $w_4$ between the end of the friction member 38 and the upper plate 33 are determined by the thickness of the thick sheets 4. For instance, when the thickness of the sheets 4 is 0.35 mm, the width $w_3$ and the clearance $w_4$ are favorably determined by 2.00 mm and 0.27 mm, respectively. The structure of the other friction member 37 is the same as that of the friction member 38.

Referring also to FIG. 6, the attachment 30 has a width which is fitted to the inside of the hopper housing 41. Inside surfaces 31A and 32A of the legs 31 and 32 serve as a guide for the stacked thick sheet 4 in a lateral direction. The width $w_5$ between the inside surfaces 31A and 32A of the legs 31 and 32 is determined in accordance with the width of the stacked thick sheets 4 which width is smaller than the distance between the front walls 45A and 46A of the pawls 45 and 46. The attachment 30 is assembled with the sheet storage cassette 40 in a manner that the front walls 35 and 36 are located under the pawls 45 and 46. The front walls 35 and 36 of the attachment 30 are subjected to the downward force by the springs 56 and 57 via the pawls 45 and 46 so as to keep contact with the uppermost sheet **4*a* of the stacked sheet 4**.

The stacked thick sheets 4 are positioned inside the attachment 30 and on the hopper plate 43. The sheets 4 are pushed upward by the hopper plate 43 so as to press against the feed rollers 22. When the attachment 30 is thus attached on the sheet storage cassette 40, the separating function of the pawls 45 and 46 is disabled.

As the feed rollers 22 are rotated by the motor 3 in the direction of arrow A, the uppermost sheet **4*a* of the stacked thick sheets 4 is fed between the slits 35S and 36S against the friction caused by the friction members 37 and 38. Owing to the friction, the other sheets 4 except for the uppermost sheet 4*a* is not fed out of the storage cassette 40** as is similar to the first embodiment.

When the attachment 30 is detached, the sheet storage cassette 40 operates as the conventional sheet feeder, as shown in FIG. 7. In this case, the thin sheets 2 are stacked in the hopper housing 41 such that the corners of the uppermost sheet **2*a* are contacted to the pawls 45 and 46. As the feed rollers 22 are rotated, the uppermost sheet 2*a* is deflected at the portion between the feed rollers 22 and the pawls 45 and 46, and then the leading edge of the uppermost sheet 2*a* goes over the pawls 45 and 46 so that the uppermost sheet 2*a* is fed out of the cassette 40**, in the same manner as the conventional sheet feeder.

Figure 8:
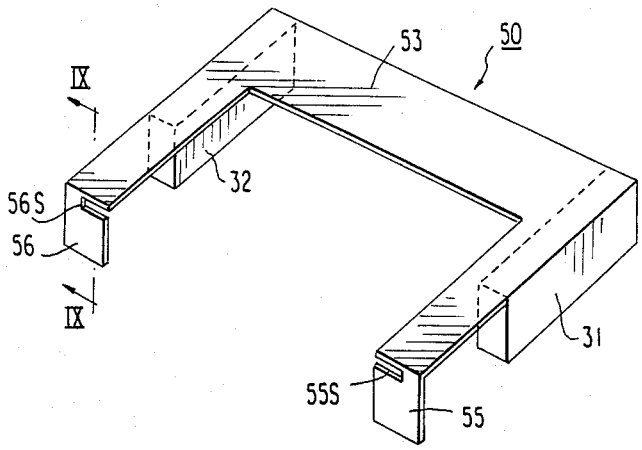
FIG. 8 is a perspective view showing an attachment according to another embodiment of the present invention.
Figure 9:
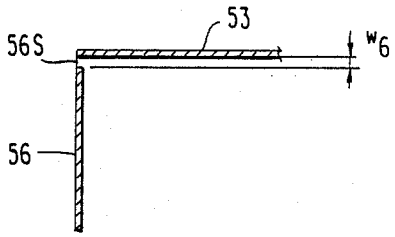
FIG. 9; is a cross sectional view taken along the line IX—IX of FIG. 8.

Although the attachment 30 shown in FIGS. 4 and 5 has front walls 35 and 36 attached the elastic member 37 and 38, the elastic member 37 and 38 can be omitted by structure as shown in FIGS. 8 and 9.

A thick sheet feeding attachment 50 is constructed substantially similar to the attachment 30 of the second embodiment. The attachment 50 of this embodiment has front walls 55 and 56 formed with slits 55S and 56S. The width of the slits 55S and 56S is determined to be slightly larger than the thickness of a thick sheet 4 which is to be passed therethrough. When the thickness of the sheet 4 is 0.22 mm, the width $w_6$ of the slit 56S is determined by 0.3 mm. The slits 55S and 56S therefore allows only one thick sheet to pass. This embodiment does not use friction members. Other components are identical to those of the second embodiment.

Besides the effects substantially similar to those achieved by the second embodiment, the attachment 50 has such advantages that the structure is simplified, productivity is increased, and its maintenance becomes easy.

Although the widths of the hopper housings 21 and 41 and attachments 30 and 50 are fixed in the above embodiments, they may be adjustably structured by dividing the lateral length thereof into two at the center so that the length can be adjusted to the size of sheets. The attachments 30 and 50 may be divided into two in the lateral direction to be attached on the internal sides of the hopper housing 21 and 41, respectively.

As described above, the present invention can provide a sheet feeder which can separate one thick sheet from the stacked thick sheets to feed to a printing mechanism by employing separators which have slits to pass the uppermost thick sheet therethrough.

What is claimed is:

1. A sheet feeder comprising:

a hopper housing or storing stacked thin or thick sheets, said hopper housing including a front opening perpendicular to a plane of said stacked thin or thick sheets;

a pair of separator pawls provided on both edge portions of said front opening for separating an uppermost sheet of said stacked thin sheets, said separator pawls being apart from each other by a first distance;

a thick sheet feeding attachment to be attached to said hopper housing when said stacked thick sheets are stored in said hopper housing and detached from said hopper housing when said stacked thin sheets are stored in said hopper housing, said thick sheet feeding attachment including a pair of front walls to be located on said both edge portions of said front opening, each of said front walls being formed with a slit parallel to a plane of a uppermost sheet of said stacked thick sheets for permitting the passage of said uppermost sheet of said stacked thick sheets, said slits being apart from each other by a second distance smaller than said first distance whereby the separating function of said separator pawls is disabled by said front walls; pressing said uppermost sheet of said stacked thin or thick sheets against feed roller means for advancing said uppermost sheet;

whereby said hopper housing and said separator pawls are utilized for feeding thin sheets and said thick sheet feeding attachment in combination with said hopper housing is utilized for feeding thick sheet.

2. A sheet feeder as claimed in claim 1 further comprising friction means provided on said front walls to cover a part of said slits.

3. A sheet feeder as claimed in claim 2, wherein said friction means is made of stainless steel spring plate.

4. A sheet feeder as claimed in claim 1, wherein said hopper housing further includes a bottom plate and side walls projected from both sides of said bottom plate substantially parallel to each other to form said front opening, said pressure means including a hopper plate provided under said stacked thin or thick sheets and a spring provided between said hopper plate and said bottom plate.

5. A sheet feeder as claimed in claim 4, wherein said thick sheet feeding attachment further includes a pair of leg portions to be located in said hopper housing at portions near said both sides of said bottom plate, said hopper plate having a pair of notch portions for receiving said leg portions.

6. A sheet feeder as claimed in claim 5, wherein said stacked thick sheets are stored between said leg portions so that a third distance between said leg portions is determined by a width of said stacked thick sheets.

* * * * *

UNITED STATES PATENT AND TRADEMARK OFFICE

CERTIFICATE OF CORRECTION

PATENT NO. : 4,828,245

DATED : May 9, 1989

INVENTOR(S) : Jun Shimogawara

It is certified that error appears in the above-identified patent and that said Letters Patent is hereby corrected as shown below:

Column 2, line 51, delete "springs 66" and insert --springs 26--.

Column 5, line 26, after "walls;" insert --pressure means provided on said hopper housing for--.

Signed and Sealed this

Twenty-eighth Day of November 1989

*Attest:*

JEFFREY M. SAMUELS

*Attesting Officer* *Acting Commissioner of Patents and Trademarks*